US005771974A

United States Patent [19]

Stewart et al.

[11] Patent Number: 5,771,974

[45] Date of Patent: Jun. 30, 1998

[54] TEST TREE CLOSURE DEVICE FOR A CASED SUBSEA OIL WELL

[75] Inventors: Adrian J. Stewart, Sommerville Park, Singapore; Christophe M. Rayssiguier, Melun; Jean-Paul Ribeyre, Vert-Saint-Denis, both of France

[73] Assignee: Schlumberger Technology Corporation, Houston, Tex.

[21] Appl. No.: 555,596

[22] Filed: Nov. 9, 1995

[30] Foreign Application Priority Data

Nov. 14, 1994 [FR] France ..... 94 13607

[51] Int. Cl.[6] ..... E21B 7/12; E21B 34/04

[52] U.S. Cl. ..... 166/336; 166/363; 166/322

[58] Field of Search ..... 166/321, 322, 166/337, 344, 336, 363, 364

[56] References Cited

U.S. PATENT DOCUMENTS

| | | | |
|---|---|---|---|
| 4,234,043 | 11/1980 | Roberts | 166/336 |
| 4,320,804 | 3/1982 | Brooks | 166/363 X |
| 4,436,157 | 3/1984 | Brooks | 166/344 |
| 4,494,609 | 1/1985 | Schwendemann | 166/336 |
| 4,658,904 | 4/1987 | Doremus et al. | 166/336 |
| 4,685,521 | 8/1987 | Raulins | 166/341 |
| 4,732,214 | 3/1988 | Yates | 166/363 X |
| 4,880,060 | 11/1989 | Schwendemann et al. | 166/336 |

*Primary Examiner*—David J. Bagnell

[57] ABSTRACT

In an offshore oil installation, the closure device (40) of a subsurface test tree placed in the blowout preventer stack on the seabed is made in a modular manner. More precisely, the closure device comprises a plurality of lengths (54,56') suitable for being placed in arbitrary order between a top element (50) and a bottom element (52). This arrangement makes it possible to place the connector (46) between the total shutoff valves (26) and the partial shutoff valves (28) of the blowout preventer stack, and to place the valves (42,44) of the closure device (40) in a closure length (54) that is situated beneath the partial shutoff valves (28). The two total shutoff valves (26) can thus be actuated regardless of the type of blowout preventer stack that is used.

20 Claims, 4 Drawing Sheets

TEST TREE CLOSURE DEVICE FOR A CASED SUBSEA OIL WELL

BACKGROUND OF THE INVENTION

1. Field of the Invention

The invention relates to a closure device for a subsurface test tree, the device being designed to be placed in a test tree of a cased subsea oil well, within a blowout preventer stack (BOP) thereof.

2. Description of Prior Art

In an offshore oil installation, the casing of a subsea well is extended upwards to the drilling platform by means of an underwater tube referred to as a "riser". More precisely, the bottom end of the riser is connected to the top end of the casing via a blowout preventer stack which rests via a base on the sea bottom. The functions of the blowout preventer stack are to enable the riser to be disconnected from the casing and to enable the well to be shut off, e.g. in the event of a storm or any other exceptional circumstances during which it would be dangerous for personnel on the drilling platform or for its equipment to maintain a rigid connection between the riser and the casing.

Before a subsea oil well is operated, tests are performed for the purpose of acquiring a certain amount of information that will be useful in such operation. This information relates in particular to the pressure and temperature that obtain downhole, the flow rate of the fluid flowing in the well, and the respective proportions of the various phases of said fluid (liquid hydrocarbon, gas, water, . . . ).

To perform such testing, a subsurface test tree fitted with test devices at its bottom end is lowered down the riser and into the cased well. The bottom of the annular gap between the cased well and the test tree is closed by an annular seal known as a "packer".

To enable the test tree to be disconnected at the blowout preventer stack, and to enable the bottom portion of said test tree remaining in the cased subsea well after disconnection to be closed, the subsurface test tree includes a test tree closure device that is placed inside the blowout preventer stack. The test tree closure device is made up of a connector and a set of valves placed beneath the connector. For redundancy purposes, the set of valves generally comprises two superposed valves. These valves include either a flap valve placed above a ball valve, for example, or else two ball valves. A third ball valve may optionally be placed beneath the other two for the purpose of cutting through a cable or a tube running along the inside of the test tree between the drilling platform and the bottom of the well, and that may possibly be present in the test tree when the riser needs to be separated from the subsea well.

The riser may need to be disconnected from the subsea well either when the test tree is present therein or when it is absent therefrom. To this end, beneath the connector, the blowout preventer stack comprises two total shutoff valves which enable the well to be fully closed, and two partial shutoff valves placed beneath the total shutoff valves and that serve to close the annular space formed between the well and the test tree. For redundancy purposes, there are two of each kind of valve.

In practice, the blowout preventer stack forms a unit of large size in which the spacing between the various valves is constant for a given type of stack. It is not possible to increase the spacing without further increasing the size of the blowout preventer stack.

Furthermore, the height of the test tree closure device cannot be reduced to less than a certain threshold because the device is itself made up of a connector superposed on at least two valves, together with hydraulic actuators for controlling those devices.

Size constraints are illustrated, in particular, by U.S. Pat. No. 4,494,609. It can be seen therein, in particular, that if the test tree closure device is given minimum size, then it is not possible simultaneously to shut off both total shutoff valves and both partial shutoff valves of the blowout preventer stack when a test tree is present, until after the connector of the test tree closure device has been actuated so as to enable the top portion of the test tree to be raised within the riser.

However, ever-increasing safety standards that apply to subsea drilling, are not satisfied by that arrangement. If the connector of the test tree closure device should happen to be jammed for any reason whatsoever when the riser is to be separated from the subsea well, then the lowest total shutoff valve contains the top portion of the test tree closure device. Under such conditions, disconnection can only be achieved by cutting the test tree above that closure device by means of the higher total shutoff valve. That means that the redundancy normally provided by the two total cutoff valves of the blowout preventer stack is no longer provided.

Further, the one-piece structure of existing test tree closure devices leads to the need to make devices that are different depending on the desires of the user, and in particular depending on the types of valve that users desire to fit to the device.

SUMMARY OF THE INVENTION

A particular object of the invention is to provide a subsurface test tree closure device of design that is original and modular, enabling the redundancy ensured by the various valves of the blowout preventer stack to be conserved even in the event of the connector fitted to the test tree closure device being jammed, and regardless of the characteristics of the blowout preventer stack used.

Another object of the invention is to provide a subsurface test tree closure device of a design that is original and modular, enabling user requirements to be satisfied with greater flexibility, and consequently enabling the overall manufacturing cost of the device to be reduced.

According to the invention, these various objects are achieved by means of a subsurface test tree closure device suitable for being placed in a test tree for a cased subsea well, inside a blowout preventer stack of the well, the device comprising a connector surmounting a set of valves and being characterized by the fact that it further comprises, between a top element including at least a top portion of the connector and a bottom element including an anchor part for anchoring the test tree to a base of the blowout preventer stack, elementary lengths that are suitable for being connected to one another and to at least the bottom element via dismountable assembly means, the elementary lengths including at least one tubular connection length and at least one closure length that itself includes at least a portion of the set of valves.

Because the major portion of the test tree closure device of the invention is made up of elementary lengths or "modules" each including at least one tubular connection length, it becomes possible to make up different custom devices based on at least some of the modules, thereby enabling account to be taken both of the dimensions of the blowout preventer stack in which the device is to be installed, and of the desires of the user.

In particular, it is possible to guarantee that all of the valves of the blowout preventer stack can be shut off, thereby preserving the redundancy of said valves, merely by interposing the tubular connection length between the top element including at least the top portion of the connector and the closure length(s) including the set of valves.

When the dimensions of the blowout preventer stack make it possible, the closure length(s) can also be assembled directly on the length that includes the bottom portion of the connector, in a configuration that is analogous to the conventional configuration. The tubular connection length is then placed between the closure length(s) and the bottom element including the anchor piece.

In order to enable the closure length to be installed at this level, it is advantageously shorter than the distance between the base and the bottom valve of the blowout preventer stack.

In comparable manner, the tubular connection length includes a central tubular portion of substantially uniform section and of a length that is advantageously greater than the combined height of both of the partial shutoff valves in the blowout preventer stack taken together.

Although the various valves of the closure device of the invention can be placed in different closure lengths, the closure length preferably includes the entire set of valves.

In a preferred embodiment of the invention, the dismountable assembly means comprise identical annular nuts and complementary threads.

Various fluid and electrical lines connect the drilling platform to the closure device or to the test devices placed downhole, which lines pass through the closure device. These fluid and electrical lines are closed off between the various lengths of the closure device by automatic fluid and electrical couplings that are associated with the dismountable assembly means. Angular position keys are also associated with the dismountable assembly means so as to ensure that the automatic couplings are aligned in a desired angular position when the lengths are assembled.

In the preferred embodiment of the invention in which the set of valves includes at least two test tree closure valves, two actuators for opening the valves, and two resilient means normally returning the valves to the closed position, the open or closed state of each of the valves in the set of valves is indicated by displacement sensors associated with the actuators. The signals delivered by the sensors are transmitted to the drilling platform via one or more electrical lines.

Advantageously, at least one pressure sensor and at least one temperature sensor are included on at least one of the interchangeable lengths and the bottom element for the purpose of transmitting the signals delivered by said pressure and temperature sensors to the drilling platform.

A multiplexing circuit is preferably included on the closure lengths and receives the signals delivered by the force, pressure, and temperature sensors in order to transmit them in turn to the surface via a single electrical line that also incorporates a connector state sensor.

Finally, when the closure device comprises a flap valve and a ball valve, together with two hydraulic lines for controlling the actuator, closure delay means are placed in one of said lines so that closure of the flap valve takes place after closure of the ball valve.

BRIEF DESCRIPTION OF THE DRAWINGS

A preferred embodiment of the invention is described below by way of non-limiting example and with reference to the accompanying drawings, in which.

DESCRIPTION OF THE PREFERRED EMBODIMENTS

Figure 1:
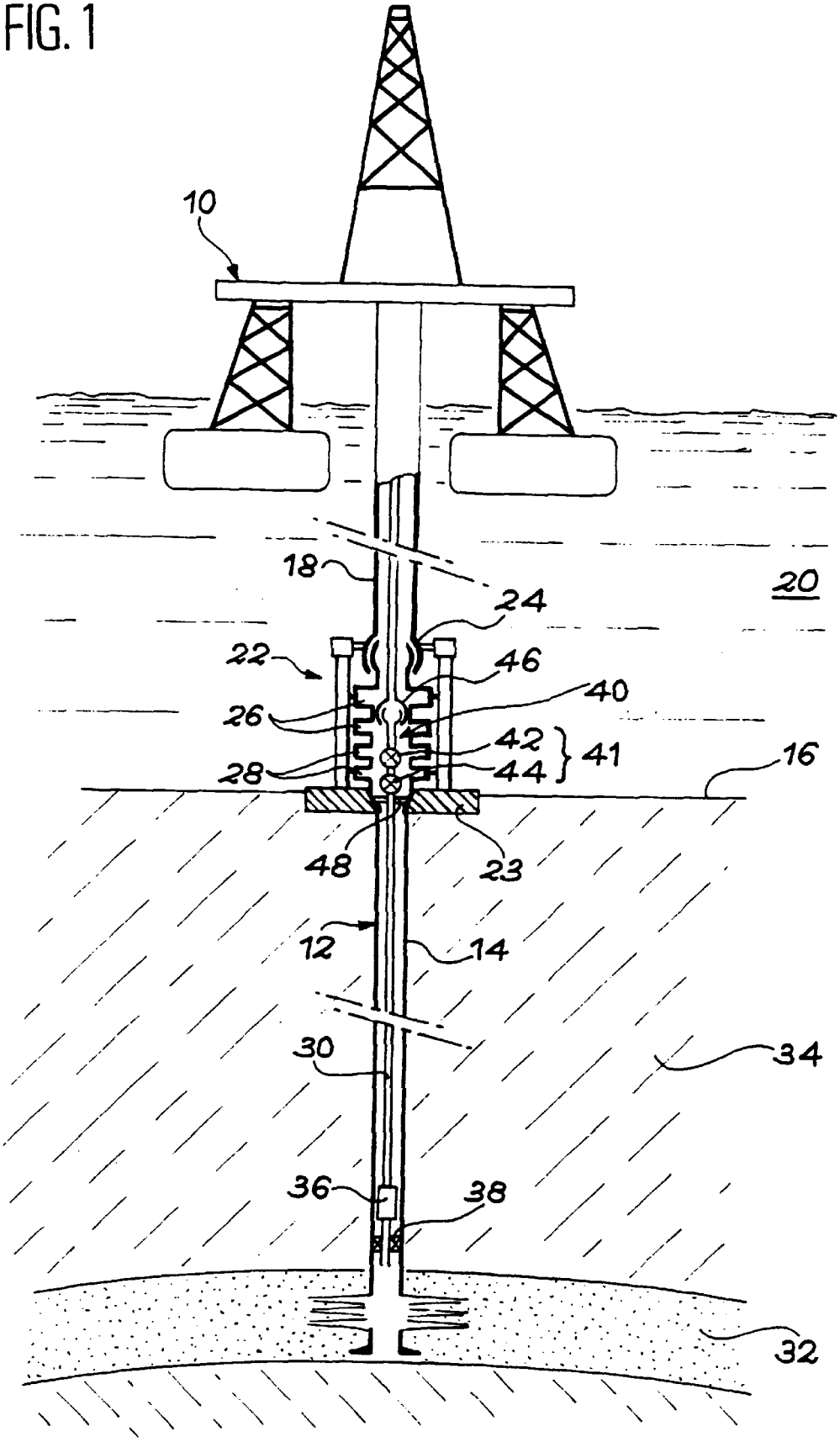
FIG. 1 is a diagrammatic side view, partially in section, showing an offshore oil installation suitable for making use of a subsurface test tree closure device of the invention.

In FIG. 1, reference 10 designates a floating or semi-submersible drilling platform. The drilling platform 10 is situated above a subsea well 12 lined with casing 14. Above the seabed 16, the casing 14 is extended upwards to the drilling platform 10 by means of a riser 18 that is located in the sea 20.

The connection at the seabed 16 between the casing 14 and the riser 18 is provided by a blowout preventer stack 22. This blowout preventer stack 22 has a base 23 to which the top of the casing 14 is fixed and via which it stands on the seabed 16.

For a detailed description of the blowout preventer stack 22, reference can be made, in particular, to U.S. Pat. No. 4,685,521 which includes a detailed description of the stack and how it operates. For a proper understanding of the present invention, there follows a description of the blowout preventer stack 22 that is brief only and given with reference to FIG. 1.

As shown in highly diagrammatic form in this figure, the blowout preventer stack 22 comprises, from top to bottom: a connector 24 which can be actuated to mechanically separate the riser 18 from the casing 14; two total shutoff valves 26; and two partial shutoff valves 28. Each of the total shutoff valves 26 serves to close completely the top end of the subsea well 12. Each of the partial shutoff valves 28 serves at the top end of the subsea well to close the annular space formed between the well 12 and a test tree 30 suitable for being lowered down the riser 18 and then into the casing 14, as shown in FIG. 1.

The bottom end of the subsurface test tree 30 opens out in a natural reservoir 32 formed in the ground 34. At this level it includes a set of test devices designated by reference 36 in FIG. 1. The devices contained in the set 36 can be very varied, and they serve in particular to measure pressure, temperature, and flow rate, and also to perform measurements for determining the relative proportions of the different phases of the fluid contained in the reservoir 32. A packer 38 closes the bottom end of the annular space that exists between the casing 14 and the test tree 30.

At the blowout preventer stack 22, the test tree 30 includes a closure device 40 for closing the subsurface test tree, and implemented in modular manner in accordance with the invention. In conventional manner, relative to the test tree 30, the closure device 40 performs functions that are comparable to the functions which are performed by the blowout preventer stack 20 between the casing 14 and the riser 18.

Thus, the closure device 40 is fitted with a set of valves 41 enabling the top end of the portion of the test tree 30 that is located in the subsea well 12 to be closed so as to make it possible to disconnect the underwater portion of the test tree that is situated between the drilling platform 10 and the seabed 16. In the example shown, the set of valves 41 comprises two superposed valves 42 and 44. Depending on circumstances, the top valve 42 is constituted either by a flap valve, or else by a ball valve. The bottom valve 44 is generally a ball valve. A third valve, e.g. a ball valve, may optionally be placed beneath the above-mentioned valves.

Above the valves 42 and 44, the closure device 40 includes a connector 46 enabling the underwater portion of the test tree 30 to be separated whenever that is necessary.

Vertical positioning and centering of the closure device 40 inside the blowout preventer stack 22 are provided by means of an anchor piece 48, e.g. in the form of diagonal bracing, secured to the test tree 30 beneath the set of valves 41. The anchor piece 48 bears against a tapering shoulder formed in the base 23 of the blowout preventer stack 22.

During testing, various tools may be lowered into the set of test devices 36. For this purpose, the tools are suspended from the bottom end of a cable or a tube which runs along the test tree 30 and passes through the closure device 40. If this situation obtains when it is necessary to separate the underwater portion of the test tree from the portion of said test tree that is situated in the subsea well 12, then the closure device 40 must be capable of cutting through said cable or said tube. This function is performed by one of the ball valves in the set of valves 41.

Figure 2A:
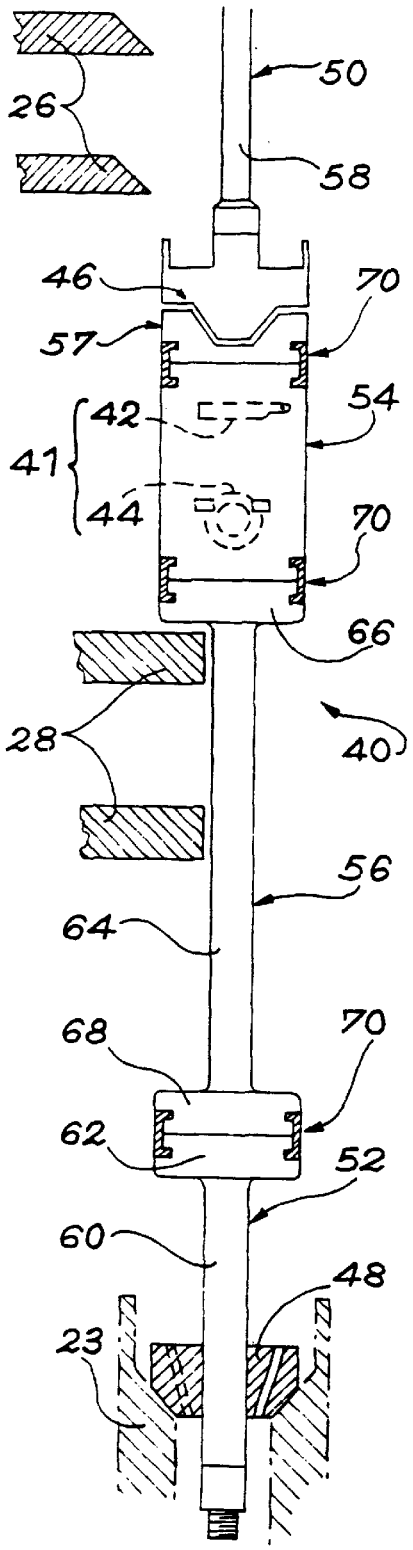
FIG. 2A is a diagram showing a first possible configuration for a modular closure device of the invention.
Figure 2B:
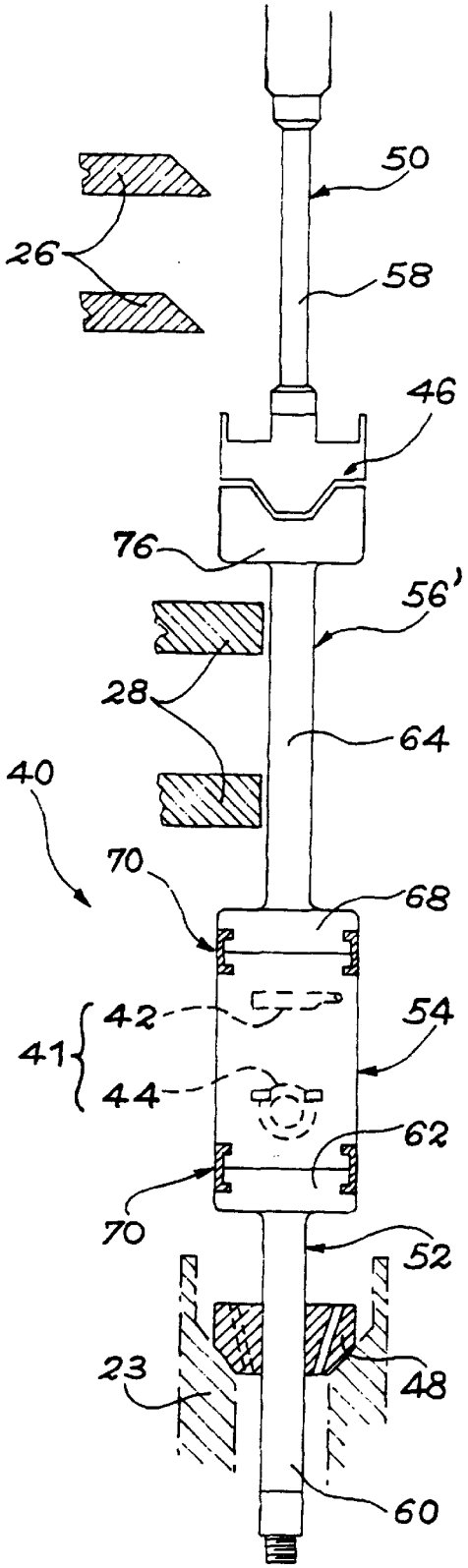
FIG. 2B is comparable to FIG. 2A and shows a second possible configuration of the modular closure device of the invention.

As shown in highly diagrammatic form in FIGS. 2A and 2B, the closure device 40 for the test tree 30 is modular in structure. This modular structure makes it possible, in particular, to adapt the closure device to different types of blowout preventer stack 22, so that actuation of any one of the total shutoff valves 26 is never prevented by the presence of any portion of the test tree engaging the valve and of a section that is too great to allow the test tree 30 to be sheared while the connector 46 remains locked.

More precisely, FIGS. 2A and 2B show two different configurations for the closure device 40 of a test tree 30 that are made possible by the modular nature of the closure device. In these two configurations, the closure device 40 includes a top element 50 fixed to the bottom of the underwater portion of the test tree 30 and a bottom element 52 fixed to the top of the portion of the test tree 30 that is received in the subsea well 12. It should be observed that the top and bottom elements 50 and 52 have the same structure regardless of which configuration is adopted.

Between these top and bottom elements 50 and 52, the closure device 40 comprises at least two elementary lengths or "modules" comprising, under all circumstances, a closure length 54 and a tubular connection length 56 or 56'.

In the embodiment shown, a third elementary length 57 is associated with the lengths 54 and 56, in the configuration of FIG. 2A. This third elementary length 57 includes the bottom portion of the connector 46 whose top portion belongs to the top element 50. It then serves as an interface between the top element 50 and the closure length 54. Under such circumstances, the tubular connection length 56 is placed between the closure length 54 and the bottom element 52.

In the configuration of FIG. 2B, the device comprises only two elementary lengths between the top element 50 and the bottom element 52. Thus the tubular connection length 56' which then includes the bottom portion of the connector 46 is directly connected beneath the top element 50, and the closure length 54 is interposed between the said tubular connection length 56' and the bottom element 52.

In other embodiments of the invention (not shown), the closure device 40 may comprise other elementary lengths, and in particular a plurality of closure lengths comparable to the length 54 and/or a plurality of tubular connection lengths comparable to the length 56.

All of the elementary lengths are interconnected, and they are also connected to the bottom element 52 of the closure device 40 by dismountable assembly means 70 that are identical.

In the configuration of FIG. 2A, there thus exists three dismountable assembly means 70 situated respectively between the third elementary length 57 and the closure length 54, between the closure length 54 and the tubular connection length 56, and between the tubular connection length 56 and the bottom element 52.

In the configuration of FIG. 2B, there exist two dismountable assembly means 70 situated respectively between the tubular connection length 56' and the closure length 54, and between the closure length 54 and the bottom element 52.

The top element 50 of the closure device 40 includes a tubular portion 58 designed to be placed facing the two total shutoff valves 26 of the blowout preventer stack 22, regardless of which configuration is adopted. In order to ensure that said tubular portion 58 can be cut by one or other of the valves 26, the length of said portion 58 is greater than the combined height of the total shutoff valves 26 taken together.

Above the tubular portion 58 of the top element 50, the test tree includes in conventional manner a retaining valve and a hydraulic unit (not shown). The retaining valve makes it possible to shut off the bottom end of the underwater portion of the test tree once it has been separated from the portion thereof that is situated inside the well. The hydraulic unit serves to control the actuators of the closure device 40.

At its bottom end, the top element 50 includes the top portion of the connector 46. Whatever configuration is adopted, all of this connector 46 is always situated below the lowest total shutoff valve 26 and above the highest partial shutoff valve 28.

The bottom element 52 of the closure device 40 includes the anchor piece 48 serving to define the vertical and centered position of the closure device within the blowout preventer stack 22. In addition, the bottom element 52 includes a tubular body 60 having the same section as the test tree 30. At its top end, the tubular body 60 is extended by a circular plate 62 whose outside diameter is substantially equal to the outside diameter of the body of the connector 46 and to the outside diameter of the bodies of the valves 42 and 44.

In the embodiment shown in FIGS. 2A and 2B, the closure length 54 includes all of the set of valves 41 of the closure device 40, i.e. both the flap valve 42 and the ball valve 44.

Regardless of the type of blowout preventer stack 22 used, the length of the closure length 54 is shorter than the height between the anchor piece 48 and the lowest partial shutoff valve 28. This characteristic makes it possible, under all circumstances, to place the closure length 54 beneath the partial shutoff valves 28, as illustrated by the configuration of FIG. 2B.

In some cases, and as illustrated by the configuration of FIG. 2A, the closure length 54 may be immediately adjacent to the connector 46, whose top and bottom portions are located respectively on the top element 50 and on the third elementary length 57. The closure length 54 and the connector 46 then form a unit which is entirely located between the total shutoff valves 26 and the partial shutoff valves 28 in a configuration that is similar to that of conventional closure devices.

Each tubular connection length 56 and 56' includes a tubular central portion 64 whose section is the same as the section of the test tree 30. The length of the tubular central portion 64 is greater than the total height of the partial shutoff valves 28 so as to allow the length 56 to be placed in said valves.

In the configuration of FIG. 2A, the tubular central portion 64 of the tubular length 56 is extended at its top end by a top circular plate 66 and at its bottom end by a bottom circular plate 68. Like the circular plate 62 of the bottom element 52, these circular plates 66 and 68 have an outside diameter that is equal to the outside diameter of the body of the connector 46 and of the bodies of the valves 42 and 44.

In the configuration of FIG. 2B, the tubular central portion 64 of the tubular connection length 56' is extended at its top end by the body 76 of the bottom portion of the connector 46, and at its bottom end by a bottom circular plate 68 similar to that fitted to the tubular connection length 56 in the configuration of FIG. 2A.

When the blowout preventer stack 22 fitted to the installation is of the type that makes it possible to locate the connector 46 and the valves 42 and 44 simultaneously between the total shutoff valves 26 and the partial shutoff valves 28, then the closure device 40 is given the configuration shown in FIG. 2A.

Otherwise, when the blowout preventer stack 22 fitted to the installation is of a type in which the separation between the total shutoff valves 26 and the partial shutoff valves 28 is insufficient to make the configuration of FIG. 2A possible, then the tubular connection length 56' is interposed between the top element 50 and the closure length 54 using the configuration shown in FIG. 2B.

In this configuration, the connector 46 remains interposed between the total shutoff valves 26 and the partial shutoff valves 28, while the valves 42 and 44 are now placed between the partial shutoff valves 28 and the anchor piece 48.

The various components of the modular closure device 40 of the invention are described below in greater detail with reference to FIGS. 3 and 4, which apply to the configuration of FIG. 2B.

Figure 3:
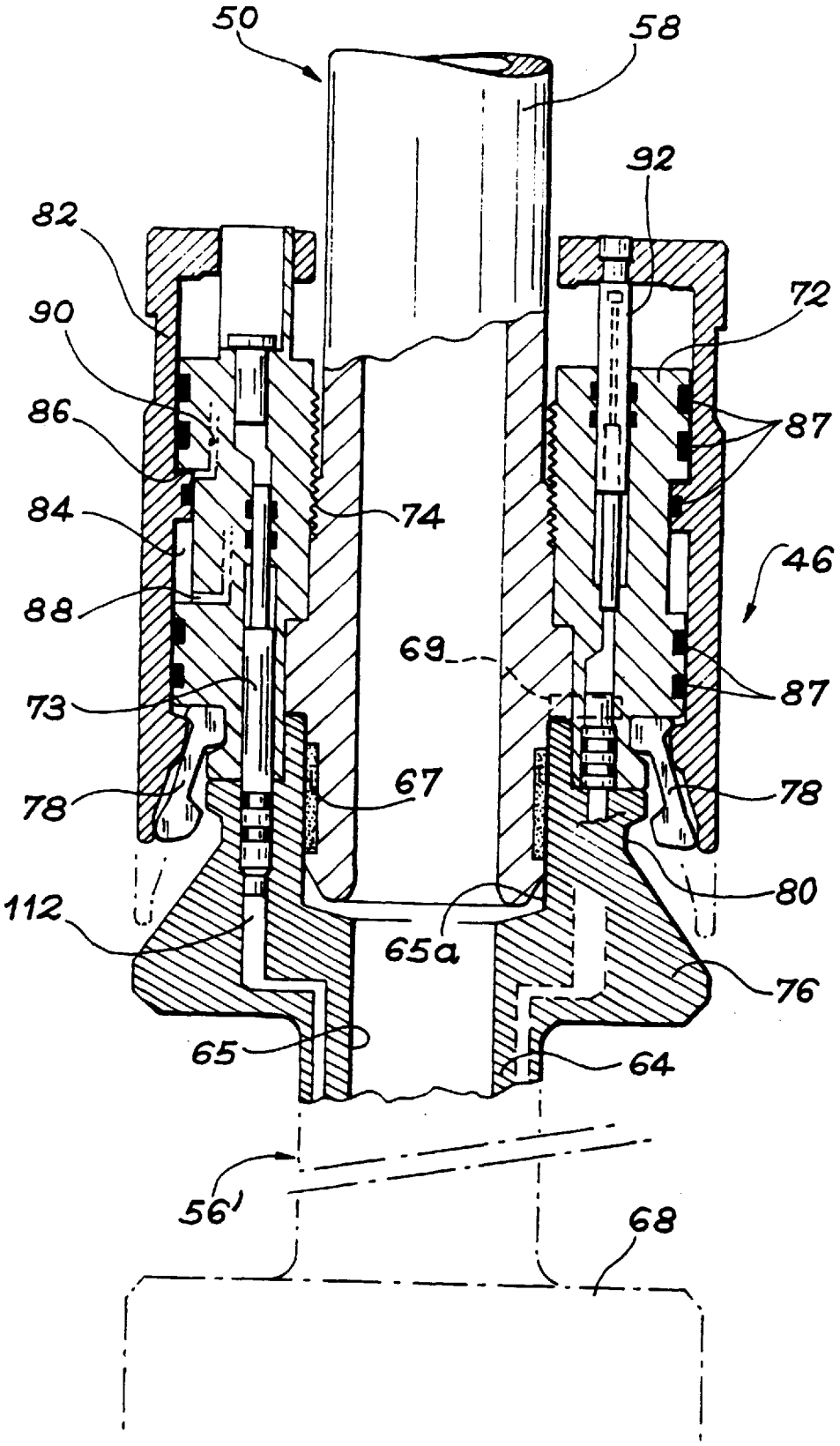
FIG. 3 is a vertical section view in greater detail showing the top portion of the modular closure device of the invention in the configuration of FIG. 2B.

In FIG. 3, only the connector 46 is shown. This connector 46 includes a top portion that constitutes the bottom portion of the top element 50 and whose body 72 is designed to be fixed to the bottom end of the tubular central portion 58 (FIG. 2B) by means of a thread 74, and a bottom portion whose body 76 forms a portion in this configuration of the tubular connection length 52.

The top and bottom portions of the connector 46 also co-operate via remotely controlled coupling means. These coupling means normally occupy a locked state in which the top and bottom portions of the connector are rigidly connected to each other. As shown in FIG. 3, they are capable of being unlocked when it is desired to separate the top and bottom portions of the connector.

In the preferred embodiment shown in FIG. 3, the coupling means comprise, at the bottom end of the body 72 of the top portion of the connector 46, hooks 78 whose ends are suitable for engaging in a groove 80 formed on the outside surface of the body 76 of the bottom portion of the connector. A hydraulic actuator for controlling the connector 46 is received in the body 72 of the top portion. This actuator is a double-acting actuator and it includes a bell-shaped annular piston 82. The annular piston 82 is slidably mounted on the body 72 to move along the axis of the closure device 40 so that its bottom end can co-operate with the hooks 78. More precisely, the piston 82 is capable of moving along the body 72 between an unlocking high position and a locking low position depending on whether hydraulic fluid under pressure is admitted respectively into a lower chamber 84 or into an upper chamber 86. The chambers 84 and 86 are formed between the annular piston 82 and the body 72. Each of the chambers 84 and 86 is sealed by sealing rings 87. The chambers 84 and 86 are fed with hydraulic fluid under pressure by respective hydraulic lines 88 and 90 which run inside the body 72 that connect with pipework (not shown) extending to the hydraulic unit (not shown) mounted in the test tree 30, above the top element 50 of the closure device 40.

When the piston 82 occupies its high position as shown in FIG. 3, then the hooks 78 are spaced apart from the groove 80 so that the connector 46 is unlocked. Under these conditions, the body 72 can be separated from the body 76.

In contrast, when the piston 82 occupies its low position, the ends of the hooks 78 are engaged in the groove 80, such that the connector 46 is locked. Under such conditions, the body 76 is rigidly connected to the body 72.

In order to ensure that the bodies 72 and 76 constituting the top and bottom portions of the connector 46 are in axial alignment, the portion of the axial passage 65 that is formed in the tubular connection length 56' includes a top portion 65*a* of larger diameter in which the bottom portion of the tubular central portion 58 is received. An annular sealing gasket 67 provides sealing between the two parts.

Under normal operating conditions of the device, a radially-directed shear-pin 69 prevents any relative rotation between the body 72 and the tubular central portion 58.

If failure of the hydraulic circuits makes it impossible to drive the hydraulic actuator controlling the connector 46, manual unlocking can still be performed by rotating the top, underwater portion of the test tree 30 from the drilling platform 10 (FIG. 1). The bottom portion of the test tree 30 is prevented from rotating downhole, and the facing ends of the bodies 72 and 76 co-operate with each other by means of complementary shapes of the claw clutch type.

Thus, the effect of rotating the top, underwater portion of the test tree 30 which is secured to the modular central portion 58, is to break the shear-pin 69 and then to raise the body 72, given that these two parts co-operate with each other via the thread 74. The body 72 entrains the annular piston 82 therewith, such that the hooks 78 are moved into their unlocking position, as shown in FIG. 3.

As shown at 92 in FIG. 3, a displacement sensor, such as a potentiometer having a return spring, is interposed between the body 72 and the annular piston 82. This displacement sensor 92 serves to inform operators situated on the drilling platform 10 (FIG. 1) whether the connector 46 is in the locked state or in the unlocked state. To this end, it is advantageously located on a single electric line (not shown) which serves in a manner explained below to connect a multiplexer circuit 144 (FIG. 4) located in the closure length 54 to the drilling platform 10. The arrival of information via said electric line thus indicates that the connector 46 has indeed been unlocked.

For the purpose, in particular, of controlling the valves 42 and 44 hydraulically from the hydraulic unit (not shown) that is situated above the closure device 40, hydraulic lines pass through the bodies 72 and 76 for the purpose of extending downwards through the tubular central portion of the tubular connection length 56'. One of these hydraulic lines is referenced 112 in FIG. 3.

When the connector 46 is locked together, the portions of these hydraulic lines that are situated in the bodies 72 and 76 are connected together end to end in sealed manner by self-closing couplings 73. The claw clutch type complementary shapes given to the ends of the bodies 72 and 76 serve to index the various lines when the two portions of the connector 46 are coupled together.

Electrical connectors (not shown) are also provided between the bodies 72 and 76, in particular to allow at least one electrical line (not shown in FIG. 3) to pass between electronic circuits located on the closure length 54 and the drilling platform 10 (FIG. 1).

Figure 4:
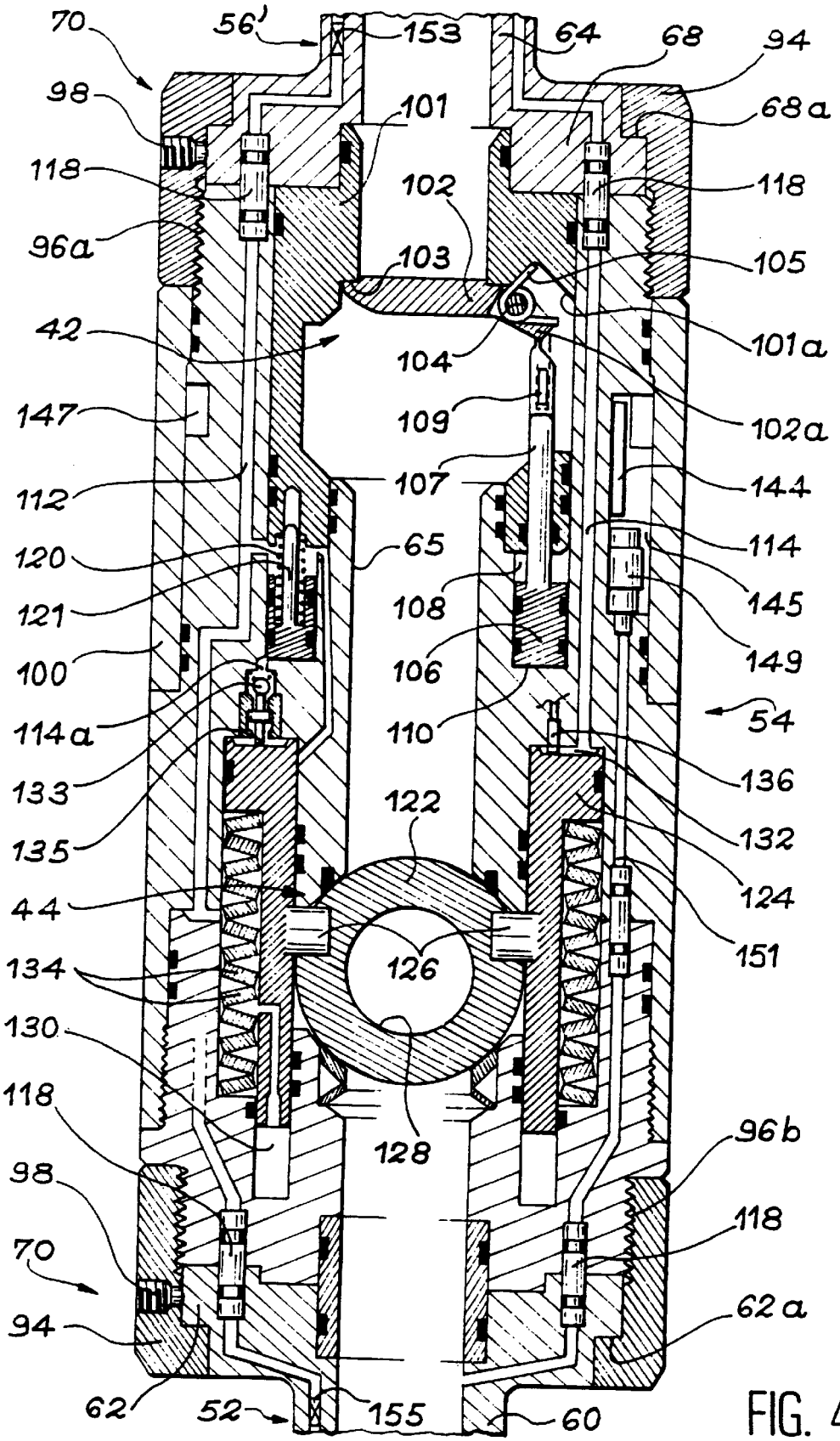
FIG. 4 is a vertical section view in greater detail showing the bottom portion of the modular closure device of the invention in the configuration of FIG. 2B.

In the embodiment shown in FIG. 4, the closure length 54 includes the set of valves 41 that is constituted by the flap valve 42 and by the ball valve 44 which is located beneath the flap valve. These two valves are housed in a tubular body 100 made up of a plurality of portions.

The flap valve 42 includes a tubular flap cage 101 that is fixed in sealed manner inside the tubular body 100. A flap 102 is pivotally mounted inside the flap cage 101 to pivot about an axis 104 that extends orthogonally to the longitudinal axis of the closure device 40.

A torsion spring 105 mounted above the axis 104 and having its ends bearing respectively against the flap cage 101 and against the flap 102 serves to keep the flap normally in the closed position shown in FIG. 4. In this position, the flap 102 bears in fluid-tight manner against a seat 103 formed in the flap cage 101, thereby closing the axial passage 65.

The flap valve 42 is opened under the control of a double-acting hydraulic actuator received in the body 100 of the closure length 54. This actuator includes an annular piston 106 slidably mounted in the body 100 to move along the axis of the closure device, beneath the flap cage 101.

The annular piston 106 carries a pusher 107 that extends upwards parallel to the axis of the closure device 40. The pusher 107 passes in sealed manner through a hole formed in the flap cage 101 and opens out into a cavity 10 la provided inside said cage. The cavity 101 a receives a slider 109 that is mounted in such a manner as to be able to slide inside the flap cage 101 parallel to the axis of the closure device 40. At its bottom end, the slider 109 is coupled to the top end of the pusher 107, e.g. via a T-section portion of the pusher that is received in a slot of complementary section formed in the slider in a direction that is perpendicular to the plane of FIG. 4. Finally, the top end of the slider 109 bears against a tail 102a of the flap 102, which tail projects into the cavity 101*a*.

When the piston 106 occupies a closed low position as shown in FIG. 4, then the pusher 107 and the slider 109, both of which are connected to the piston 106, are likewise in a low position. Consequently, the flap 102 is held in its closed position by the torsion spring 105.

When the piston 106 moves towards a high position for opening the flap valve 42, it urges the tail 102*a* of the flap 102 upwards via the pusher 107 and the slider 109. The flap 102 then pivots downwards about its axis 104 into an open position in which the axial passage 65 is clear.

The displacements of the piston 106 respectively towards its low position and towards its high position for closing and for opening the flap valve 42 are controlled by injecting hydraulic fluid under pressure respectively into an upper annular chamber 108 and into a lower annular chamber 110 formed in the body 100 on either side of the piston 106. To this end, the chambers 108 and 110 are fed with hydraulic fluid via respective hydraulic lines 112 and 114. These hydraulic lines 112 and 114 pass through the body 100 of the closure length 54 and extend upwards to the hydraulic unit (not shown) placed in the test tree above the closure device 40.

Given the modular nature of the closure device, continuity of hydraulic lines such as the lines 112 and 114 between the closure module 54 and the hydraulic unit is ensured by the presence of hydraulic line portions in the dismountable lengths that are suitable for being interposed between the closure length 54 and the top element 50. In the configuration shown in FIGS. 3 and 4, portions of the lines 112 and 114 are thus provided in the tubular connection length 52' and in the top element 50.

Given that the hydraulic lines 112 and 114 are placed in peripheral positions about the longitudinal axis of the closure device, the various portions of these hydraulic lines are coupled together during assembly of the lengths in such a manner that accurate angular positioning of the lengths is ensured. For this purpose, the facing faces of the bodies of the various lengths 54 and 56' and of the bottom element 52 include rotation indexing means. By way of example, these rotation indexing means may comprise a finger (not shown) which projects downwards from the plane bottom face of each of the lengths 54 and 56', so as to be capable of penetrating into respective complementary holes formed in the plane top faces of the length 56' and of the bottom element 52.

In addition, in order to ensure that the hydraulic line portions formed in the various lengths and in the bottom element are coupled together in leakproof manner when the dismountable assembly means 70 are actuated, automatic fluid couplings of the kind shown at 118 in FIG. 4 are provided on the facing plane faces of the various lengths 54, 56, and of the bottom element 52 of the closure device. By way of example, these automatic fluid couplings may comprise a respective male part projecting from the top face of each of the parts 52 and 54 in line with the corresponding portions of each hydraulic line. During assembly, each of these male parts is engaged in leakproof manner in a complementary bore formed in the bottom face of each of the parts 54 and 56', at the end of each corresponding hydraulic line portion.

It should be observed that the same technique can be used for at least one hydraulic line (not shown) running along the entire height of the closure device 40 so as to feed devices situated beneath this assembly with hydraulic fluid, e.g. devices situated in the set of test devices 36 placed at the bottom of the well.

As shown in FIG. 4, resilient return means, e.g. constituted by helical compression springs 120 are placed in the top chamber 108 of the actuator for controlling the flap valve 42 and they are regularly distributed around the circumference of said chamber. These return means 120 hold the flap 102 in its closed position when no hydraulic fluid under pressure is being injected into the bottom chamber 110.

A displacement sensor 121 such as a potentiometer with a return spring is interposed between the annular piston 106 and the flap cage 101. The sensor 121 is preferably housed inside one of the springs 120. Its function is to inform operators situated on the drilling platform 10 (FIG. 1) whether the flap valve 42 is in its open state or in its closed state. The sensor 121 is connected by electrical conductors (not shown) to the multiplexing circuit 144.

The ball valve 44 comprises a spherical closure member 122 placed on the axial passage 65 and having a bore 128 passing radially therethrough. The spherical closure member 122 is pivotally mounted on the body 100 to pivot about an axis that is orthogonal to the longitudinal axis of the axial passage 65. This axis may be embodied, in particular, by two stub axles (not shown).

In addition, the spherical closure member 122 is mounted to pivot about a second axis parallel to the above axis in an annular piston 124 that is mounted to slide inside the body 100 along the longitudinal axis thereof. This second axis is embodied by two stub axles 126 that are secured to the piston 124. It is offset relative to the preceding axis in a direction that is perpendicular to the plane of FIG. 4.

The annular piston 124 constitutes the moving element of a double-acting hydraulic actuator that serves to control opening and closing of the ball valve 44. To this end, the annular piston 124 can move inside the body 100 between a high, closed position as illustrated in FIG. 4, and a low, open position. In the high, closed position of the piston 124, the spherical closure member 122 occupies a position such that the bore 128 passing therethrough extends perpendicularly to the longitudinal axis of the closure device 40. As a result, the axial passage 65 is then closed. In contrast, when the piston 124 is in its low position, the bore 128 formed through the spherical closure member 122 is in alignment with the axial passage 65.

Displacements of the piston 124 between its high position and its low position are controlled by admitting hydraulic fluid under pressure into one or other of a lower annular chamber 130 and an upper annular chamber 132 that are formed between the piston 124 and the body 100. As before, this admission takes place from the hydraulic unit (not shown) placed above the closure device 40, via the respective hydraulic lines 112 and 114.

For safety reasons, it is preferable for the flap valve 42 to close after the ball valve 44 has closed. The flap 102 would run the risk of being damaged if it were to close while fluid was flowing at a high rate along the axial passage 65.

In order to ensure that the flap valve 42 closes after a delay, the hydraulic line 114 opens out into the upper annular chamber 132 of the actuator controlling the ball valve 44 and includes a passage 114*a* connecting said chamber 132 to the lower annular chamber 108 of the actuator controlling the flap valve 42. This passage 114a contains a valve 133 that delays opening. The valve 133 is closed by a spring so as to leave a passage of small section between the chambers 108 and 132, when the annular piston 124 controlling the ball valve 44 occupies its low, open position. When the annular piston 124 occupies its high, closed position, its top face lifts the valve member of the valve 133 away from its seat by means of a push rod 135. The chambers 108 and 132 then communicate with each other freely.

The piston 124 is returned towards its high position in which it closes the ball valve 44 by resilient return means constituted, for example, by a stack of spring washers 134 received in the lower annular chamber 130.

A displacement sensor 136, such as a potentiometer and a return spring, is located in the upper annular chamber 132 between the body 100 and the top face of the annular piston 124. The function of the sensor 136 is to inform operators situated on the drilling platform 10 (FIG. 1) whether the ball valve 44 is in its open state or in its closed state. The sensor 136 is connected by electrical conductors (not shown) to the multiplexer circuit 144.

The multiplexer circuit 144 and all of the other electronic cards (not shown) included in the closure device 40 are received in separate chambers formed in the body 100 of the closure module 54 about the axial passage 65. The chamber in which the multiplexing circuit 144 is received is identified by reference 145 in FIG. 4. All of the chambers that receive electronic cards are connected together by means of an annular channel 147 that serves to convey electrical conductors.

A pressure and temperature sensor 149 is housed in one of the chambers formed in the body 100 like the chamber 145 in FIG. 4. A passage 151 runs through the body 100 of the closure length 54, and then through the circular plate 62 of the bottom element 52, for the purpose of connecting the sensor 149 to the axial passage 65 inside the bottom element 52. Thus, pressure is measured beneath the valves 42 and 44. Conductors (not shown) connect the pressure and temperature sensor 149 to the multiplexer circuit 144, from which pressure and temperature information supplied by the sensor 149 is sent up to the drilling platform 10 (FIG. 1) via the above-mentioned single electrical line.

Two temperature sensors 153 and 155 (FIG. 4) are respectively mounted in the tubular connection length 56' and in the bottom element 52 in order to establish the temperature that obtains at the level of the partial shutoff valves 28. Each of these sensors 153 and 155 is connected to the multiplexer circuit 144 by electrical conductors (not shown).

The various signals coming from the sensors 121, 136, 149, 153, and 155, which are conveyed to the multiplexing card 144 via separate electrical conductors, are subsequently transmitted to the drilling platform 10 via the above-mentioned single electrical line. This single electrical line includes the sensor 92 (FIG. 3), such that signal transmission also informs the operator that the connector 46 is properly locked.

To take account of the modular nature of the closure device 40, the electrical line connecting the multiplexer card 144 to the drilling platform 10, and also the lines connecting the sensors situated on parts other than the closure length 54 to the multiplexer card 144 are constituted by different portions inside the closure device. These portions which extend through the closure length 54 and also through the tubular connection length 56 and through the top and bottom elements 50 and 52 are automatically brought into alignment with one another when the device is assembled in the desired configuration by using the dismountable assembly means 70. In addition, the electrical line portions are electrically connected together automatically because of the presence of automatic electrical couplings (not shown) which are placed at the junctions between the dismountable lengths and the top and bottom elements of the closure device.

An electrical line (not shown) runs along the entire height of the closure device for the purpose of connecting the set of downhole test devices 36 to the drilling platform 10 via the test tree 30.

In the configuration shown in FIG. 4, the closure length 54 is dismountably coupled firstly to the tubular connection length 56' and secondly to the bottom element 52 via dismountable assembly means 70 that are identical to each other.

Each of these dismountable assembly means 70 comprises an annular nut 94. One of the annular nuts 94 is carried by the bottom circular plate 68 of the tubular connection length 56', while the other annular nut is carried by the top circular plate 62 of the bottom element 52. These annular nuts 94 are suitable for engaging on threads 96*a*, 96*b* formed respectively on a top end portion and on a bottom end portion of the body 100 of the closure length 54. Their facing faces are clamped against one another by the annular nuts 94 coming to bear respectively against shoulders 68*a* and 62*a* formed on the circular plates 68 and 62. Accidental loosening of the annular nuts 94 is prevented by brake screws 98 that pass radially through each of the annular nuts 94.

It will be understood that use of the dismountable assembly means 70 makes it possible to assemble together the various lengths making up the closure device 40 in the desired configuration, as a function of the size of the blowout preventer stack 22 (FIG. 1). The structure given to said dismountable assembly means 70 in the preferred embodiment as described above provides the desired modularity, without thereby penalizing the mechanical strength of the test tree at the closure device.

Under normal test conditions, the valves 42 and 44 are in the open position and the connector 46 is in its locked state. The closed state of the valves 42 and 44 is ensured by the combined action of the springs 120 and of the spring washers 134.

When it appears desirable to unlock the connector 46, the valves 42 and 44 are actuated initially for the purposes of closing the axial passage 65 and of shearing a cable or a tube that may possibly be running along the test tree 30.

Then, under control from the drilling platform 10, hydraulic fluid is injected into the upper annular chamber 108 of the actuator controlling the flap valve 42 and into the lower annular chamber 130 of the actuator controlling the ball valve 44. The hydraulic fluid from the hydraulic unit (not shown) placed above the closure device 40 is conveyed to those chambers by the hydraulic line.

Simultaneously, the hydraulic fluid contained in the lower annular chamber 110 of the actuator controlling the flap valve 42, and in the upper annular chamber 132 of the actuator controlling the ball valve 44, is exhausted towards the hydraulic unit via the hydraulic line 114. However, because the annular piston 124 of the actuator controlling the ball valve 44 is still in its low position, the opening delay valve 133 remains pressed against its seat. The passage 114*a* thus presents a small section, thereby significantly slowing down the exhausting of hydraulic fluid from the lower annular chamber 110 of the actuator controlling the flap valve 42.

Consequently, the arrival of fluid under pressure via the hydraulic line 112 begins by causing the ball valve 44 to close.

Once the piston 124 of the actuator controlling the ball valve 44 reaches its high position, it pushes the rod 135, thereby lifting the valve member of the valve 133 off its seat. Hydraulic fluid can then exhaust freely from the lower annular chamber of the actuator controlling the flap valve 42. Consequently, the flap valve 42 is closed later on, after the ball valve 44 has already closed.

Naturally, the modular closure device of the invention can be modified in various different ways without going beyond the ambit of the invention. Thus, by way of example, the nuts 94 could be replaced by any dismountable assembly means that enable the lengths to be interchangeable, e.g. a bayonet system. In addition, the number and kind of lengths can also be modified, as already mentioned.

We claim:

1. A subsurface test tree closure device suitable for being placed in a test tree for a cased subsea well, inside a blowout preventer stack of the well which includes two total closure valves placed above two partial closure valves, and a base below the partial closure valves, comprising:

a bottom element including an anchor part for anchoring the device to said base;

a top element;

a connector, said top element including at least a top portion of said connector;

at least one closure length including a set of valves;

at least one tubular connection length; and dismountable assembly means for connecting either one of said lengths to said connector and the other one to said bottom element, and said closure length to said tubular connection length.

2. A closure device according to claim 1 wherein the closure length includes all of the set of valves.

3. A closure device according to claim 1 wherein the dismountable assembly means comprise identical annular nuts and complementary threads.

4. A closure device according to claim 1 wherein annular position keys and automatic fluid and electrical couplings are associated with the dismountable assembly means to close fluid and electrical lines that terminate at the closure device and that pass through said device.

5. A closure device according to claim 1 wherein the set of valves includes at least two valves for closing the test tree, two actuators for controlling opening of said valves, and two resilient means normally urging said valves into the closed position, displacement sensors being associated with the actuators for transmitting signals to the surface indicative of the open or closed state of each of the valves in the set of valves.

6. A closure device according to claim 5 further including:

a multiplexer circuit in the closure length, that receives the signals issued by the sensors to transmit them in turn to the surface via a single electrical line that includes a sensor for sensing the state of the connector.

7. A closure device according to claim 6 further including:

a flap valve and a ball valve, together with two hydraulic lines for controlling the actuators, means for delaying closure being placed in one of said lines so that closure of the flap valve takes place after closure of the ball valve.

8. A closure device according to claim 5 further including:

a flap valve and a ball valve, together with two hydraulic lines for controlling the actuators, means for delaying closure being placed in one of said lines so that closure of the flap valve takes place after closure of the ball valve.

9. A closure device according to claim 1 further including:

at least one pressure sensor and at least one temperature sensor in at least one of the interchangeable lengths, and the bottom element, for transmitting to the surface signals delivered by said pressure and temperature sensors.

10. A closure device according to claim 1, wherein said closure length is shorter than the distance between said base and the bottom one of said partial closure valve.

11. A closure device according to claim 10 wherein the closure length includes all of the set of valves.

12. A closure device according to claim 10 wherein the dismountable assembly means comprise identical annular nuts and complementary threads.

13. A closure device according to claim 10 wherein annular position keys and automatic fluid and electrical couplings are associated with the dismountable assembly means to close fluid and electrical lines that terminate at the closure device and that pass through said device.

14. A closure device according to claim 10 wherein the set of valves includes at least two valves for closing the test tree, two actuators for controlling opening of said valves, and two resilient means normally urging said valves into the closed position, displacement sensors being associated with the actuators for transmitting signals to the surface indicative of the open or closed state of each of the valves in the set of valves.

15. A closure device according to claim 14 further including:

a flap valve and a ball valve, together with two hydraulic lines for controlling the actuators, means for delaying closure being placed in one of said lines so that closure of the flap valve takes place after closure of the ball valve.

16. A closure device according to claim 10 further including:

at least one pressure sensor and at least one temperature sensor in at least one of the interchangeable lengths, and the bottom element, for transmitting to the surface signals delivered by said pressure and temperature sensors.

17. A closure device according to claim 14 further including:

a multiplexer circuit in the closure length, that receives the signals issued by the sensors to transmit them in turn to the surface via a single electrical line that includes a sensor for sensing the state of the connector.

18. A closure device according to claim 17 further including:

a flap valve and a ball valve, together with two hydraulic lines for controlling the actuators, means for delaying closure being placed in one of said lines so that closure of the flap valve takes place after closure of the ball valve.

19. A closure device according to claim 10, wherein said tubular connection length is of a length greater than the total height of said partial closure valves taken together.

20. A closure device according to claim 1, wherein said tubular connection length is of a length greater than the total height of said partial closure valves taken together.

* * * * *

UNITED STATES PATENT AND TRADEMARK OFFICE

CERTIFICATE OF CORRECTION

PATENT NO. : 5,771,974

DATED : June 30, 1998

INVENTOR(S) : Stewart, et. al.

It is certified that error appears in the above-identified patent and that said Letters Patent is hereby corrected as shown below:

Column 4, line 64, delete "20" and replace with --22--.

Column 7, line 53, delete "52" and replace with --56'--.

Column 10, line 16, delete "52'" and replace with --56'--.

Column 10, line 38, delete "56" and replace with --56'--.

Column 11, line 44, delete "108" and replace with --110--.

Column 11, line 47, delete "108" and replace with --110--.

Column 11, line 52, delete "108" and replace with --110--.

Signed and Sealed this

Sixth Day of April, 1999

*Attest:*

Q. TODD DICKINSON

*Attesting Officer*

*Acting Commissioner of Patents and Trademarks*